US009745650B2

(12) United States Patent
Ueda et al.

(10) Patent No.: US 9,745,650 B2
(45) Date of Patent: Aug. 29, 2017

(54) AUSTENITE HEAT-RESISTING CAST STEEL

(71) Applicants: TOYOTA JIDOSHA KABUSHIKI KAISHA, Toyota-shi, Aichi (JP); KABUSHIKI KAISHA TOYOTA CHUO KENKYUSHO, Nagakute-shi, Aichi (JP)

(72) Inventors: Takamichi Ueda, Toyota (JP); Harumi Ueno, Toyota (JP); Takashi Maeshima, Nagakute (JP); Hirofumi Ito, Nagakute (JP); Kazuaki Nishino, Nagakute (JP); Hideaki Ikehata, Nagakute (JP)

(73) Assignees: TOYOTA JIDOSHA KABUSHIKI KAISHA, Toyota-shi, Aichi (JP); KABUSHIKI KAISHA TOYOTA CHUO KENKYUSHO, Nagakute-shi, Aichi (JP)

( * ) Notice: Subject to any disclaimer, the term of this patent is extended or adjusted under 35 U.S.C. 154(b) by 162 days.

(21) Appl. No.: 14/602,338

(22) Filed: Jan. 22, 2015

(65) Prior Publication Data

US 2015/0225823 A1 Aug. 13, 2015

(30) Foreign Application Priority Data

Feb. 13, 2014 (JP) ..... 2014-025580

(51) Int. Cl.

| | |
|---|---|
| ***C22C 38/60*** | (2006.01) |
| ***C22C 38/00*** | (2006.01) |
| ***C22C 38/34*** | (2006.01) |
| ***C22C 38/42*** | (2006.01) |
| ***C22C 38/48*** | (2006.01) |
| ***C22C 38/58*** | (2006.01) |
| ***C22C 38/08*** | (2006.01) |
| ***C22C 38/14*** | (2006.01) |
| ***C22C 38/50*** | (2006.01) |
| ***C21D 6/00*** | (2006.01) |

(52) U.S. Cl.

CPC ..... *C22C 38/60* (2013.01); *C21D 6/004* (2013.01); *C22C 38/001* (2013.01); *C22C 38/08* (2013.01); *C22C 38/14* (2013.01); *C22C 38/34* (2013.01); *C22C 38/42* (2013.01); *C22C 38/48* (2013.01); *C22C 38/50* (2013.01); *C22C 38/58* (2013.01); *C21D 2211/001* (2013.01); *C21D 2211/004* (2013.01); *C21D 2211/005* (2013.01)

(58) Field of Classification Search

CPC ..... C22C 38/001; C22C 38/08; C22C 38/14; C22C 38/34; C22C 38/42; C22C 38/48; C22C 38/50; C22C 38/58; C22C 38/60; C21D 6/004; C21D 2211/001; C21D 2211/004; C21D 2211/005

See application file for complete search history.

(56) References Cited

U.S. PATENT DOCUMENTS

| | | | | |
|---|---|---|---|---|
| 4,434,006 | A | 2/1984 | Kato et al. | |
| 6,383,310 | B1 | 5/2002 | Otsuka et al. | |
| 2007/0217941 | A1* | 9/2007 | Hayashi | C22C 38/001 420/38 |
| 2013/0130058 | A1 | 5/2013 | Iseda et al. | |
| 2015/0167134 | A1 | 6/2015 | Leistner et al. | |

FOREIGN PATENT DOCUMENTS

| | | | |
|---|---|---|---|
| CN | 102510909 | A | 6/2012 |
| DE | 30 18 537 | A1 | 11/1980 |
| DE | 10 2012 104 260 | A1 | 11/2013 |
| EP | 1 498 508 | A1 | 1/2005 |
| EP | 1 826 288 | A1 | 8/2007 |
| EP | 2 662 462 | A1 | 11/2013 |
| JP | 07-228948 | A | 8/1995 |
| JP | 09-287022 | A | 11/1997 |
| JP | 2000-291430 | A | 10/2000 |

* cited by examiner

*Primary Examiner* — Roy King
*Assistant Examiner* — Caitlin Kiechle
(74) *Attorney, Agent, or Firm* — Sughrue Mion, PLLC

(57) ABSTRACT

Provided is austenite heat-resisting cast steel with reduced precipitation of ferrite phase during the application of thermal load to stabilize the austenite structure for improved heat resistance. The austenite heat-resisting cast steel contains elements of 0.1 to 0.6 mass % of C, 1.0 to 2.5 mass % of Si, 1.0 to 3.5 mass % of Mn, 0.05 to 0.2 mass % of S, 14 to 24 mass % of Cr, 5 to 20 mass % of Ni, 0.1 to 0.3 mass % of N, 0.01 to 1.2 mass % of Zr, 0.01 to 1.5 mass % of Cu, 0.01 to 1.5 mass % of Nb, Fe as a remainder and unavoidable impurity. The elements satisfy the following expressions:

$$Mn-S \geq 1.0; \text{ and}$$

$$C-(1/12Cr-32Zr)>0,$$

where symbols for elements in these expressions represent values indicating content of the elements corresponding to the symbols in a unit of atomic %.

4 Claims, 2 Drawing Sheets

AUSTENITE HEAT-RESISTING CAST STEEL

BACKGROUND

Technical Field

The present invention relates to austenite heat-resisting cast steel, and particularly relates to austenite heat-resisting cast steel that has an excellent thermal fatigue resistance property.

Background Art

Conventionally austenite heat-resisting cast steel has been used for components of an exhaust system in an automobile, such as an exhaust manifold and a turbine housing. Such components are used in severe environment at high temperatures, and so for excellent thermal fatigue resistance, they are required to have excellent high-temperature strength and such toughness from room temperatures to high temperatures.

From such a point, Patent Document 1, for example, proposes austenite heat-resisting cast steel containing 0.2 to 1.0 mass % of C, 0.05 to 0.6 mass % of C—Nb/8, 2 mass % or lower of Si, 2 mass % or lower of Mn, 8 to 20 mass % of Ni, 15 to 30 mass % of Cr, 0.5 to 6 mass % of Nb, 1 to 6 mass % of W, 0.01 to 0.3 mass % of N, 0.01 to 0.5 mass % of S, Fe as a remainder and unavoidable impurity.

Patent Document 2 proposes austenite heat-resisting cast steel containing 0.05 to 0.65 mass % of C, 0.10 to 3.0 mass % of Si, 0.10 to 11.0 mass % of Mn, 3 to 40 mass % of Ni, 12 to 23 mass % of Cr, N≤10.5 mass %, and the effective Ca amount, which is represented with [Ca mass %]−0.9[O mass %], that is −0.0020 or more.

RELATED ART DOCUMENTS

Patent Documents

Patent Document 1: JP H07-228948 A
Patent Document 2: JP H09-287022 A

SUMMARY

The austenite heat-resisting cast steel described in Patent Document 1 aims to stabilize the austenite structure by containing 8 to 20 mass % of Ni (nickel) therein, and Patent Document 2 aims to stabilize the austenite structure by containing excessive amount of Mn (manganese) therein as compared with that in conventional austenite heat-resisting cast steel.

Both of the austenite heat-resisting cast steel of these documents, however, contains Cr (15 to 30 mass % of Cr in Patent Document 1, 12 to 23 mass % of Cr in Patent Document 2), and so they tend to generate precipitation of chromium carbide ($Cr_{23}C_6$) at the crystal grain boundary when thermal load is applied thereto. Such chromium carbide precipitated results in a decrease of C (carbon) in the austenite structure that is an element to stabilize the austenite structure. This results in a failure to achieve fundamental stabilization of the austenite structure because the effect of stabilization will be cancelled due to the decrease of C even when Ni and Mn are added as described in Patent Documents 1 and 2, which are elements to stabilize austenite. This may cause the precipitation of ferrite phase in the austenite structure when thermal load is applied thereto.

Mn (manganese) added as described in Patent Document 2 also may result in the generation of MnS when S (sulfur) is added, and in that case, the machinability will be improved, but Mn, which contributes to the stabilization of austenite structure, may decrease.

In view of these points, the present invention aims to decrease the precipitation of ferrite phase in austenite heat-resisting cast steel when thermal load is applied thereto, thus stabilizing the austenite structure and achieving austenite heat-resisting cast steel having excellent heat resistance.

A lot of experiments and further studies performed by the present inventors have led to a new finding that addition of Zr (zirconium) to austenite heat-resisting cast steel makes the austenite crystal grains finer and can disperse Cr (chromium) segregated at crystal grain boundary. This can decrease the concentration of Cr at the crystal grain boundary and decrease the amount of C (carbon) binding to Cr around the crystal grain boundary, resulting in the stabilization of the austenite structure. Such an idea is totally different from the conventional technical idea of stabilizing an austenite structure by adding a lot of Ni and Mn that are elements to stabilize austenite. The present inventors then considers it important to keep Mn in austenite heat-resisting cast steel, which does not bind to S, and to dissolve this in the austenite crystal grains.

The present invention is based on such a new finding by the present inventors, and austenite heat-resisting cast steel according to the present invention contains elements of 0.1 to 0.6 mass % of C, 1.0 to 2.5 mass % of Si, 1.0 to 3.5 mass % of Mn, 0.05 to 0.2 mass % of S, 14 to 24 mass % of Cr, 5 to 20 mass % of Ni, 0.1 to 0.3 mass % of N, 0.01 to 1.2 mass % of Zr, 0.01 to 1.5 mass % of Cu, 0.01 to 1.5 mass % of Nb, Fe as a remainder and unavoidable impurity. The elements satisfy Expression (1) and Expression (2) in the following:

$$Mn—S \geq 1.0 \quad (1); \text{ and}$$

$$C-(1/12Cr-32Zr)>0 \quad (2),$$

where symbols for elements in Expressions (1) and (2) represent values indicating content of the elements corresponding to the symbols in a unit of atomic %.

The austenite heat-resisting cast steel according to the present invention contains iron (Fe) as a base, and contains the above-stated carbon (C), silicon (Si), manganese (Mn), sulfur (S), chromium (Cr), nickel (Ni), nitrogen (N), zirconium (Zr), copper (Cu) and niobium (Nb) in the above-stated range as the basic components, where the entire is represented as 100 mass %.

A first aspect of the present invention is based on the consideration given to MnS and $Cr_{23}C_6$ created in theory. Specifically, in the first aspect of the present invention, the relationship Mn (atomic %)−S (atomic %)≥1.0 as indicated in Expression (1) holds, whereby even when MnS is generated, Mn that contributes to stabilize the austenite structure can be dissolved in the austenite crystal grains and can be kept in the austenite crystal grains.

Then in the first aspect of the present invention, C(atomic %)−(1/12Cr(atomic %)−32Zr(atomic %))>0 as indicated in Expression (2) holds. Thereby, assuming the effect from Expression (1), the austenite crystal grains can be made finer due to Zr, and so Cr (chromium) segregated at the crystal grain boundary can be dispersed. This can decrease the Cr concentration at the crystal grain boundary, and so can suppress chromium carbide ($Cr_{23}C_6$) around the crystal grain boundary. This can prevent C, which is an element to stabilize the austenite structure, from decreasing.

This results in a decrease of the precipitation of ferrite phase during heating, thus stabilizing the austenite structure and increasing heat resistance properties such as the thermal fatigue resistance, the high-temperate strength, and the high-temperature oxidization resistance.

Then, assuming the content of the constituent elements as stated above, the austenite heat-resisting cast steel enables Mn, which contributes to the stabilization of the austenite structure, to be dissolved in the austenite crystal grains, and can disperse Cr (chromium) segregated at the crystal grain boundary because the austenite crystal grains are made finer due to Zr. This can decrease the Cr concentration at the crystal grain boundary, and can suppress chromium carbide ($Cr_{23}C_6$) around the crystal grain boundary.

Then, assuming that the above-stated Expressions (1) and (2) hold, the following Expression (3) preferably holds as well:

$$-2.35Ni-3.36Mn-1.46Cr+2.03Si-0.48Nb-0.51Zr-0.47Cu+49.86\leq 3 \quad (3),$$

where the symbols for elements in Expression (3) represent values indicating the content of the elements corresponding to the symbols in the unit of mass %.

This aspect has been considered based on the ferrite amount of the austenite heat-resisting cast steel that was actually generated when thermal load was applied to the austenite heat-resisting cast steel containing the elements in the above-stated ranges. Specifically, elements that highly contribute to the generation of ferrite phase were specified, and the relationship between the content of these elements and the amount of ferrite phase generated (ferrite amount) was formulated using statistics as in the above-stated Expression (3).

Herein although carbon that is dissolved has the effect of stabilizing austenite, some of the carbon added forms carbide, and so the precise amount of carbon that dissolves in austenite is uncertain. Then Expression (3) does not have a term relating to carbon, and instead Expression (2) specifies the amount of carbon.

The calculated value of the left side in Expression (3) represents the amount of ferrite (mass %) that was found based on the experiment performed by the present inventors described later, using regression by a multiple regression analysis, and the elements shown on the left side thereof highly contribute the generation of ferrite phase during the application of thermal load. As is evident from this expression as well, the coefficient of Mn is the negative value and has the largest absolute value among these elements, meaning that Mn highly contributes to suppress the generation of ferrite phase. When the calculated value of the left side of Expression (3) is 3 (mass %) or less, the amount of ferrite (mass %) will be 3 mass % or less, and so the austenite structure will be stabilized.

In a preferable aspect, the austenite heat-resisting cast steel contains Zr in a range of 0.25 to 0.5 mass %. This can decrease the amount of ferrite phase generated during the application of thermal load, even when the content of Ni and Mn is limited. When the content of Zr is less than 0.25 mass %, the effect from Zr to make the austenite crystal grains finer may not be enough. In that case, chromium carbide may segregate at the crystal grain boundary, and the amount of ferrite may increase. If the content of Zr exceeds 0.5 mass %, C (carbon) that is an element to stabilize the austenite structure may decrease in the austenite structure because Zr and C precipitate at the crystal grain boundary.

Austenite heat-resisting cast steel according to the present invention includes reduced precipitation of ferrite phase during the application of thermal load, whereby the austenite structure can be stabilized for improved heat resistance.

DETAILED DESCRIPTION OF THE EMBODIMENT

Figure 1:
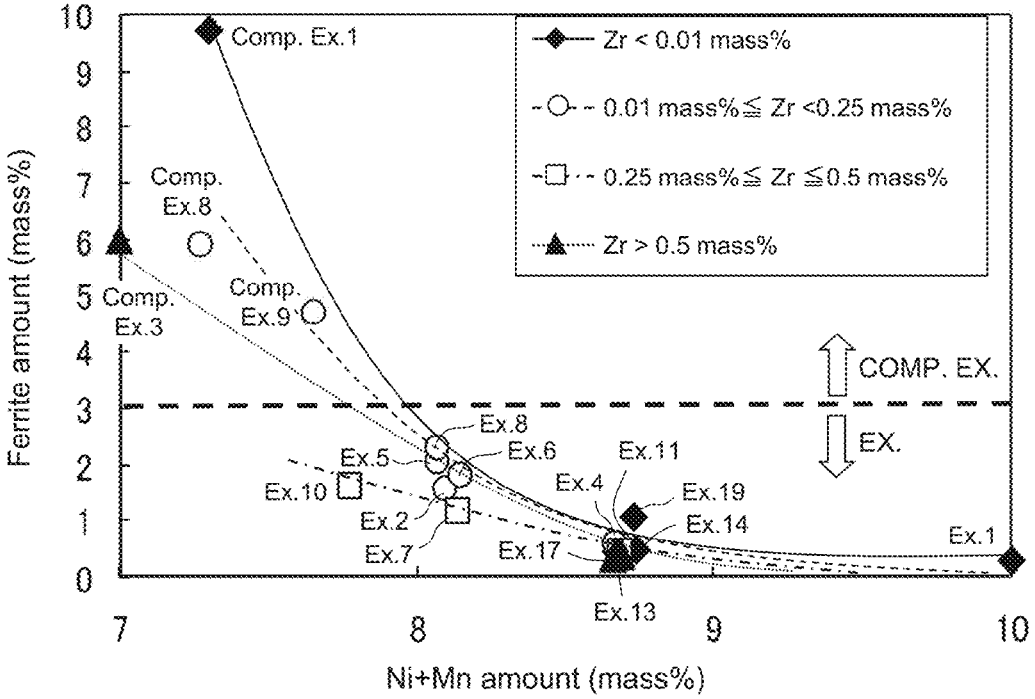
FIG. 1 shows the relationship between the amount of Ni+Mn and the amount of ferrite contained in the austenite heat-resisting cast steel according to Examples and Comparative Examples that are selected from Examples 1 to 21 and Comparative Examples 1 to 10 based on the range of the content of Zr added.

The following describes austenite heat-resisting cast steel according to one embodiment of the present invention.

Austenite heat-resisting cast steel according to the present embodiment contains 0.1 to 0.6 mass % of C, 1.0 to 2.5 mass % of Si, 1.0 to 3.5 mass % of Mn, 0.05 to 0.2 mass % of S, 14 to 24 mass % of Cr, 5 to 20 mass % of Ni, 0.1 to 0.3 mass % of N, 0.01 to 1.2 mass % of Zr, 0.01 to 1.5 mass % of Cu, 0.01 to 1.5 mass % of Nb, Fe as a remainder and unavoidable impurity. The followings are the details of these elements and their content.

<C (Carbon): 0.1 to 0.6 Mass %>

C in the above-stated range serves as an element to stabilize the austenite structure and is effective to improve the high-temperature strength and the castability. When the content is less than 0.1 mass %, such an effect for improvement of the castability is small. When the content exceeds 0.6 mass %, the stiffness of the structure increases due to precipitation of CrC and the toughness also deteriorates. This may degrade the machinability of the austenite heat-resisting cast steel.

<Si (Silicon): 1.0 to 2.5 Mass %>

Si in the above-stated range is effective to improve the oxidation resistance and the castability. When the content is less than 1.0 mass %, the castability may be degraded, and when the content exceeds 2.5 mass %, the machinability of the austenite heat-resisting cast steel will deteriorate.

<Mn (Manganese): 1.0 to 3.5 Mass %>

Mn in the above-stated range promotes a deacidification reaction and stabilizes the austenite structure. When the content is less than 1.0 mass %, no deacidification effect is exerted, and a failure in casting will occur. Additionally, the stabilization of the austenite structure deteriorates, and so the thermal fatigue life deteriorates. When the content exceeds 3.5 mass %, irregularities may be generated at the cast due to a reaction with the mold made of silicon oxide ($SiO_2$) during casting, leading to surface roughness. Further since deformation-induced martensite may be generated during the processing, the machinability of the austenite heat-resisting cast steel deteriorates.

<S (Sulfur): 0.05 to 0.2 Mass %>

S in the above-stated range can ensure the machinability. When the content is less than 0.05 mass %, the machinability deteriorates. When the content exceeds 0.2 mass %, a great amount of sulfide will be generated, which decreases the thermal fatigue life.

<Cr (Chromium): 14 to 24 Mass %>

Cr in the above-stated range increases the oxidation resistance and is effective to improve the high-temperature strength. When the content is less than 14 mass %, the effect of oxidation resistance deteriorates. When the content exceeds 24 mass %, ferrization will be promoted when thermal load is applied thereto.

<Ni (Nickel): 5 to 20 Mass %>

Ni in the above-stated range can stabilize the austenite structure. When the content is less than 5 mass %, the oxidation resistance and the stabilization of austenite structure deteriorate, and so the thermal fatigue life decreases. When the content exceeds 20 mass %, the castability will be degraded. In the present embodiment, when the content thereof exceeds 10 mass %, the effect to stabilize the austenite structure is saturated. In this respect, the content of Ni is preferably 5 to 10 mass %.

<N (Nitrogen): 0.1 to 0.3 Mass %>

N in the above-stated range is effective to improve the high-temperature strength, stabilize the austenite phase and create a finer structure. When the content is less than 0.1 mass %, such an effect is not enough, and when the content exceeds 0.3 mass %, the yield decreases extremely, which may be a factor of gas defects.

<Zr (Zirconium): 0.01 to 1.2 Mass %>

Zr in the above-stated range can create finer austenite crystal grains, disperse Cr (chromium) segregated at the crystal grain boundary, and so stabilize the austenite structure. This can improve the oxidation resistance of the austenite heat-resisting cast steel as well. Additionally since the crystal grains are made finer, MnS can be dispersed finely in the austenite structure, and so the machinability can be improved. When the content is less than 0.01 mass %, the effect to stabilize the austenite structure and improve the oxidization resistance is not expected, and when the content exceeds 1.2 mass %, ZrC, ZrN will be generated, which leads to a decrease in the amount of dissolved C and N in the austenite crystal grains, and may cause the instability of austenite structure. Further since such ZrC, ZrN exists as an inclusion at the crystal grain boundary, the machinability of the austenite heat-resisting cast steel deteriorates.

In order to make such effects greater, it is preferable to contain Zr in the range of 0.25 to 0.5 mass %. Specifically when the content of Zr is less than 0.25 mass %, the effect from Zr to make the austenite crystal grains finer may not be enough. In the case of limiting the content of Ni and Mn, if the content of Zr exceeds 0.5 mass %, the austenite structure may be instable because of ZrC precipitated.

<Cu (Copper): 0.01 to 1.5 Mass %>

Cu in the above-stated range can stabilize the austenite structure. Note here that the austenite structure may be instable due to the binding of Mn and S and the binding of C and Cr as stated above. However Cu hardly generates such binding, and so directly leads to the stabilization of the austenite structure. When the content is less than 0.01 mass %, it is difficult to expect such an effect, and when the content exceeds 1.5 mass %, the oxidization resistance of the austenite heat-resisting cast steel deteriorates.

<Nb (Niobium): 0.01 to 1.0 Mass %>

Nb forms fine carbide in the austenite structure, and so can increase the high-temperature strength and creep rupture strength. When the content is less than 0.01 mass %, such an effect is not exerted, and when the content exceeds 1.5 mass %, the oxidization resistance and the machinability deteriorate. More preferably the content is 0.1 to 1.0 mass %.

<Other Elements>

The content of P, which is contained as unavoidable impurity, is preferably 0.05 mass % or less. When the content exceeds this, thermal degradation easily occurs due to the repeated heating and cooling, and the toughness also deteriorates. The content exceeding this may be a factor of casting cracks.

Assuming that the above-stated components of C, Si, Mn, S, Cr, Ni, N, Zr, Cu and Nb in the above-stated ranges are added to the austenite heat-resisting cast steel, the present embodiment meets the following Expressions (1) and (2) (first invention):

$$\text{Mn—S} \geq 1.0 \quad (1); \text{ and}$$

$$\text{C}-(1/12\text{Cr}-32\text{Zr})>0 \quad (2)$$

where the symbols for elements in Expressions (1) and (2) represent values indicating the content of the elements corresponding to the symbols in the unit of atomic % (at %).

That is, when the relationship Mn (atomic %)−S(atomic %)≥1.0 as indicated in Expression (1) holds, and even when MnS is generated, at least 1.0 atomic % or more of Mn that does not bind to S can be kept. This enables Mn, which contributes to the stabilization of the austenite structure, to be dissolved in the austenite crystal grains, which can be kept in the austenite crystal grains. When Mn that does not bind to S is less than 1.0 atomic %, the effect from Mn to stabilize the austenite structure may not be obtained sufficiently.

Further, in the case of C(atomic %)−(1/12Cr(atomic %)−32Zr(atomic %))>0 as indicated in Expression (2), the austenite crystal grains are made finer due to Zr, and so Cr (chromium) segregated at the crystal grain boundary can be dispersed. This can decrease the Cr concentration at the crystal grain boundary, and so can suppress chromium carbide ($Cr_{23}C_6$) around the crystal grain boundary. This results in a decrease of the precipitation of ferrite phase during heating, thus stabilizing the austenite structure and increasing heat resistance properties such as the thermal fatigue resistance, the high-temperate strength, and the high-temperature oxidization resistance.

Further, assuming that the above-stated components of C, Si, Mn, S, Cr, Ni, N, Zr, Cu and Nb in the above-stated ranges are added to the austenite heat-resisting cast steel as well as the assumption of the above-stated Expression (1) or (2), the present embodiment preferably meets the following Expression (3):

$$-2.35\text{Ni}-3.36\text{Mn}-1.46\text{Cr}+2.03\text{Si}-0.48\text{Nb}-0.51\text{Zr}-0.47\text{Cu}+49.86 \leq 3 \quad (3)$$

where the symbols for elements in Expression (3) represent values indicating the content of the elements corresponding to the symbols in the unit of mass %.

The calculated value of the left side of Expression (3) represents the amount of ferrite (mass %) of the austenite heat-resisting cast steel that was found based on the experiment performed by the present inventors described later, using regression by a multiple regression analysis, which substantially agrees with the total amount (ferrite amount) of the ferrite phase that is precipitated at the austenite heat-resisting cast steel when thermal load was actually applied to the austenite heat-resisting cast steel. The coefficients of the elements on the left side indicate the degree of contribution to generation or suppression of ferrite phase during the application of thermal load. For example, since Ni, Mn have a large effect of suppressing the generation of ferrite phase, the coefficients thereof are negative values and have large absolute values. When the content of the elements indicated in Expression (3) satisfy the relationship as indicated in Expression (3), the ferrite amount α (mass %) will be 3 mass % or less, and so the austenite structure will be stabilized.

EXAMPLES

The following describes the present invention specifically, by way of examples and comparative examples.

Example 1

35 kg of a sample as a starting material of the austenite heat-resisting cast steel having the composition shown in Table 1 and containing Fe as a base was prepared, which then underwent air dissolution using a high-frequency induction furnace. The thus obtained molten metal was taken out at 1,600° C. and then was poured into a sand mold (not preheated) of 25 mm×25 mm×300 mm at 1,550° C. for solidification, whereby a block piece of the austenite heat-resisting cast steel of JIS Y block B type was obtained. A test piece of 5 mm×5 mm×5 mm was then cut out from this block piece, which was held at an air atmosphere furnace at 700° C. for 200 hours. Then the test piece was taken out from the furnace, and was cooled. Table 1 represents the content of the constituent elements of the austenite heat-resisting cast steel according to Example 1 in the units of mass % and atomic % (at %).

The following value M and value P were calculated for Table 1, and it was then confirmed that they satisfied Expression (1) and Expression (2) as follows:

$$M=\mathrm{Mn(at\ \%)}-\mathrm{S(at\ \%)}\geq 1.0 \quad (1);\ \text{and}$$

$$P=\mathrm{C(at\ \%)}-\{1/12\mathrm{Cr(at\ \%)}-32\mathrm{Zr(at\ \%)}\}>0 \quad (2).$$

Examples 2 to 21

Similarly to Example 1, test pieces made of austenite heat-resisting cast steel were prepared. Specifically the test pieces were prepared by casting using samples having the components as in Table 1, and heat treatment was applied to the test pieces under the same heating condition as in Example 1.

Table 1 represents the content of the constituent elements of the austenite heat-resisting cast steel according to Examples 2 to 21 as well as Example 1 in the units of mass % and atomic % (at %). The above-stated value M and value P also were calculated for Table 1, and it was then confirmed that they satisfied Expression (1) and Expression (2) as stated above.

Comparative Examples 1 to 10

Similarly to Example 1, test pieces made of austenite heat-resisting cast steel were prepared. Specifically the test pieces were prepared by casting using samples having the components as in Table 1, and heat treatment was applied to the test pieces under the same heating condition as in Example 1.

Table 2 represents the content of the constituent elements of the austenite heat-resisting cast steel according to Comparative Examples 1 to 10 in the units of mass % and atomic % (at %). The above-stated value M and value P also were calculated for Table 2, and it was then confirmed that they did not satisfy either one or both of Expression (1) and Expression (2) as stated above.

<Measurement of Amounts of the Elements>

The content of carbon and sulfur in the austenite heat-resisting cast steel shown in Table 1 and Table 2 was measured using a high-frequency combustion-infrared based carbon/sulfur analyzer (produced by Horiba, Ltd. EMIA-3200). Specifically a sample was prepared, containing tungsten combustion improver (chip-form, the rate of carbon content: 0.01% or less), magnesium perchlorate (anhydrous, grain size: 0.7 to 1.2 mm) and Ascharite. This sample and the austenite heat-resisting cast steel as stated above were molten under the oxygen (dry oxygen having purity of 99.999% or more) atmosphere in a high-frequency crucible (ceramic crucible) for measurement. The dust filter used was fiberglass.

The content of nitrogen in the austenite heat-resisting cast steel shown in Table 1 and Table 2 was measured using an oxygen/nitrogen analyzer (produced by LECO, type TC-436). Specifically a sample made of Anhydrone (magnesium perchlorate), Ascharite (carbon dioxide absorber), copper oxide (granulated) and metallic copper (ribbon-form) was prepared. This sample and the austenite heat-resisting cast steel as stated above were molten under the mixed gas atmosphere containing the mixture of helium (less than 99.99 mass %) and argon (less than 99.99 mass %) in a graphite crucible for measurement of nitrogen. The dust filter used was fiberglass.

The content of silicon in the austenite heat-resisting cast steel shown in Table 1 and Table 2 was measured by a silicon dioxide gravimetric method. Specifically a sample made of the austenite heat-resisting cast steel as stated above was decomposed with aqua regia, to which perchloric acid was added for evaporation by heating, to make silicon insoluble silicon dioxide. After filtration, the resultant underwent ignition for constant mass. Next, hydrofluoric acid was added thereto for vaporization and volatilization of silicon dioxide, and the amount of silicon was determined from the decrease amount. The content of other elements in the austenite heat-resisting cast steel shown in Table 1 and Table 2 was measured by a general IPC emission spectrometry.

<Measurement for Amount of Ferrite>

Test pieces of 5 mm×5 mm×5 mm of the austenite heat-resisting cast steel of Examples 1 to 21 and Comparative Examples 1 to 10 were used to measure the values of saturation magnetization using a vibrating sample magnetometer (VSM), whereby the amount of ferrite (mass %) was calculated. Table 1 shows the result.

FIG. 1 shows the relationship between the amount of Ni+Mn and the amount of ferrite contained in the austenite heat-resisting cast steel according to typical Examples and Comparative Examples among Examples 1 to 21 and Comparative Examples 1 to 10.

<Observation of Structure>

Figure 2:
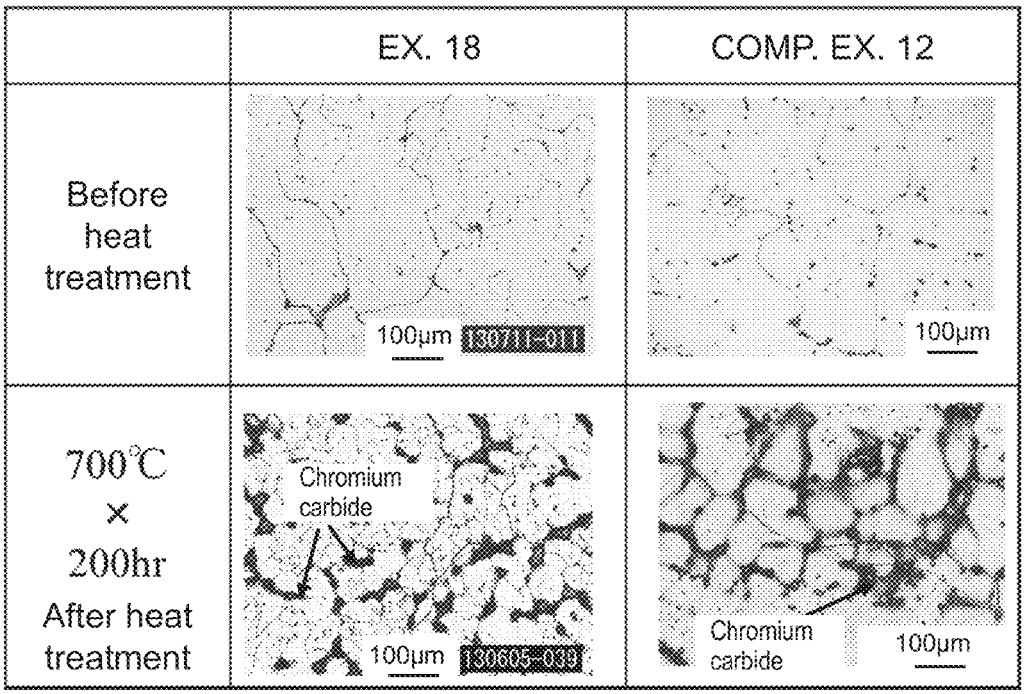
FIG. 2 shows the photographs of the structure before and after heat treatment of austenite heat-resisting cast steel according to Example 18 and Comparative Example 2.

After grinding the surfaces of the test pieces of the austenite heat-resisting cast steel according to Example 18 and Comparative Example 2 before and after heat treatment and performing marble etching thereto, they were observed with an optical microscope. FIG. 2 shows the result. FIG. 2 shows the photographs of the structure before and after heat treatment of the austenite heat-resisting cast steel according to Example 18 and Comparative Example 2.

TABLE 1

| | Ferrite amount | | Components | | | | | | | | | | | | Value | Value |
|---|---|---|---|---|---|---|---|---|---|---|---|---|---|---|---|---|
| | (%) | | C | Si | Mn | P | S | Cr | Ni | N | Zr | Cu | Nb | Fe | P | M |
| EX. 1 | 0.26 | mass % | 0.32 | 1.97 | 1.54 | ≤0.05 | 0.092 | 20.00 | 8.85 | 0.18 | 0.02 | 0.01 | 0.45 | Bal. | 0.09 | 1.34 |
| | | at % | 1.42 | 3.74 | 1.50 | 0.03 | 0.153 | 20.52 | 8.04 | 0.69 | 0.01 | 0.01 | 0.26 | | | |
| EX. 2 | 1.54 | mass % | 0.30 | 1.94 | 3.02 | ≤0.05 | 0.093 | 19.80 | 5.08 | 0.17 | 0.04 | 0.01 | 0.06 | | 0.39 | 2.77 |
| | | at % | 1.33 | 3.68 | 2.93 | 0.03 | 0.154 | 20.28 | 4.61 | 0.65 | 0.02 | 0.01 | 0.03 | | | |
| EX. 3 | 1.52 | mass % | 0.31 | 2.01 | 1.51 | ≤0.05 | 0.150 | 17.10 | 8.96 | 0.20 | 0.28 | 0.01 | 0.50 | | 5.17 | 1.22 |
| | | at % | 1.38 | 3.83 | 1.47 | 0.03 | 0.250 | 17.59 | 8.16 | 0.76 | 0.16 | 0.01 | 0.29 | | | |
| EX. 4 | 0.56 | mass % | 0.34 | 1.92 | 2.72 | ≤0.05 | 0.087 | 20.30 | 5.95 | 0.23 | 0.12 | 0.06 | 0.01 | | 2.01 | 2.49 |
| | | at % | 1.50 | 3.63 | 2.63 | 0.03 | 0.144 | 20.73 | 5.38 | 0.87 | 0.07 | 0.05 | 0.01 | | | |
| EX. 5 | 2.01 | mass % | 0.29 | 1.97 | 3.04 | ≤0.05 | 0.084 | 19.70 | 5.03 | 0.18 | 0.1 | 0.01 | 0.01 | | 1.47 | 2.81 |
| | | at % | 1.29 | 3.73 | 2.95 | 0.03 | 0.139 | 20.17 | 4.56 | 0.68 | 0.06 | 0.01 | 0.01 | | | |
| EX. 6 | 1.79 | mass % | 0.30 | 2.00 | 3.15 | ≤0.05 | 0.094 | 19.70 | 5.00 | 0.18 | 0.25 | 0.01 | 0.01 | | 4.32 | 2.90 |
| | | at % | 1.33 | 3.79 | 3.05 | 0.03 | 0.156 | 20.17 | 4.53 | 0.68 | 0.15 | 0.01 | 0.01 | | | |
| EX. 7 | 1.15 | mass % | 0.32 | 2.01 | 3.12 | ≤0.05 | 0.091 | 19.80 | 5.02 | 0.19 | 0.27 | 0.01 | 0.02 | | 4.77 | 2.87 |
| | | at % | 1.42 | 3.80 | 3.02 | 0.03 | 0.151 | 20.25 | 4.55 | 0.72 | 0.16 | 0.01 | 0.01 | | | |
| EX. 8 | 2.29 | mass % | 0.30 | 1.91 | 3.05 | ≤0.05 | 0.088 | 19.80 | 5.02 | 0.18 | 0.25 | 0.01 | 0.01 | | 4.32 | 2.81 |
| | | at % | 1.33 | 3.62 | 2.96 | 0.03 | 0.146 | 20.29 | 4.56 | 0.69 | 0.15 | 0.01 | 0.01 | | | |
| EX. 9 | 2.38 | mass % | 0.30 | 1.99 | 3.07 | ≤0.05 | 0.087 | 19.80 | 5.02 | 0.19 | 0.43 | 0.01 | 0.03 | | 7.68 | 2.83 |
| | | at % | 1.33 | 3.77 | 2.98 | 0.03 | 0.144 | 20.28 | 4.56 | 0.72 | 0.25 | 0.01 | 0.02 | | | |
| EX. 10 | 1.58 | mass % | 0.30 | 1.98 | 2.82 | ≤0.05 | 0.120 | 20.20 | 5.00 | 0.26 | 0.35 | 0.01 | 0.01 | | 6.13 | 2.53 |
| | | at % | 1.33 | 3.74 | 2.73 | 0.03 | 0.199 | 20.63 | 4.52 | 0.99 | 0.20 | 0.01 | 0.01 | | | |
| EX. 11 | 0.44 | mass % | 0.31 | 1.94 | 2.76 | ≤0.05 | 0.084 | 20.10 | 5.93 | 0.24 | 0.44 | 0.06 | 0.01 | | 7.88 | 2.54 |
| | | at % | 1.37 | 3.67 | 2.68 | 0.03 | 0.139 | 20.57 | 5.38 | 0.91 | 0.26 | 0.05 | 0.01 | | | |
| EX. 12 | 2.29 | mass % | 0.30 | 1.94 | 3.18 | ≤0.05 | 0.088 | 20.00 | 5.00 | 0.22 | 0.59 | 0.01 | 0.01 | | 10.65 | 2.94 |
| | | at % | 1.33 | 3.68 | 3.09 | 0.03 | 0.146 | 20.49 | 4.54 | 0.84 | 0.34 | 0.01 | 0.01 | | | |
| EX. 13 | 0.40 | mass % | 0.31 | 1.98 | 2.79 | ≤0.05 | 0.085 | 20.00 | 5.90 | 0.26 | 0.79 | 0.53 | 0.02 | | 14.43 | 2.57 |
| | | at % | 1.38 | 3.75 | 2.71 | 0.03 | 0.141 | 20.49 | 5.35 | 0.99 | 0.46 | 0.44 | 0.01 | | | |
| EX. 14 | 0.48 | mass % | 0.31 | 1.95 | 2.79 | ≤0.05 | 0.082 | 20.20 | 5.95 | 0.26 | 0.02 | 1.00 | 0.10 | | 0.03 | 2.57 |
| | | at % | 1.37 | 3.69 | 2.70 | 0.03 | 0.136 | 20.65 | 5.39 | 0.99 | 0.01 | 0.84 | 0.06 | | | |
| EX. 15 | 0.42 | mass % | 0.32 | 1.94 | 2.75 | ≤0.05 | 0.090 | 20.20 | 5.92 | 0.24 | 0.02 | 0.06 | 0.08 | | 0.07 | 2.51 |
| | | at % | 1.42 | 3.67 | 2.66 | 0.03 | 0.149 | 20.64 | 5.36 | 0.91 | 0.01 | 0.05 | 0.05 | | | |
| EX. 16 | 1.57 | mass % | 0.33 | 2.03 | 2.82 | ≤0.05 | 0.086 | 20.40 | 5.91 | 0.26 | 0.90 | 0.06 | 0.01 | | 16.52 | 2.59 |
| | | at % | 1.46 | 3.84 | 2.73 | 0.03 | 0.142 | 20.86 | 5.35 | 0.99 | 0.52 | 0.05 | 0.01 | | | |
| EX. 17 | 0.34 | mass % | 0.35 | 2.00 | 2.82 | ≤0.05 | 0.084 | 20.30 | 5.84 | 0.30 | 1.09 | 0.01 | 0.03 | | 20.14 | 2.59 |
| | | at % | 1.55 | 3.78 | 2.73 | 0.03 | 0.139 | 20.74 | 5.29 | 1.14 | 0.64 | 0.01 | 0.02 | | | |
| EX. 18 | 1.49 | mass % | 0.33 | 2.00 | 2.76 | ≤0.05 | 0.088 | 19.80 | 5.93 | 0.30 | 1.16 | 0.06 | 0.50 | | 21.47 | 2.53 |
| | | at % | 1.47 | 3.79 | 2.68 | 0.03 | 0.146 | 20.30 | 5.39 | 1.14 | 0.68 | 0.05 | 0.29 | | | |
| EX. 19 | 1.04 | mass % | 0.31 | 1.99 | 2.80 | ≤0.05 | 0.089 | 20.00 | 5.93 | 0.29 | 0.02 | 0.06 | 0.10 | | 0.04 | 2.56 |
| | | at % | 1.37 | 3.76 | 2.71 | 0.03 | 0.147 | 20.40 | 5.36 | 1.10 | 0.01 | 0.05 | 0.06 | | | |
| EX. 20 | 0.70 | mass % | 0.31 | 2.07 | 2.79 | ≤0.05 | 0.088 | 20.00 | 5.92 | 0.30 | 1.00 | 0.06 | 0.01 | | 18.33 | 2.56 |
| | | at % | 1.37 | 3.92 | 2.70 | 0.03 | 0.146 | 20.45 | 5.36 | 1.14 | 0.58 | 0.05 | 0.01 | | | |
| EX. 21 | 0.43 | mass % | 0.31 | 1.96 | 2.77 | ≤0.05 | 0.087 | 20.20 | 5.90 | 0.30 | 1.07 | 0.06 | 0.01 | | 19.64 | 2.54 |
| | | at % | 1.38 | 3.71 | 2.69 | 0.03 | 0.144 | 20.68 | 5.35 | 1.14 | 0.62 | 0.05 | 0.01 | | | |

TABLE 2

| | Ferrite amount | | Components | | | | | | | | | | | | Value | Value |
|---|---|---|---|---|---|---|---|---|---|---|---|---|---|---|---|---|
| | (%) | | C | Si | Mn | P | S | Cr | Ni | N | Zr | Cu | Nb | Fe | P | M |
| COMP. | 9.72 | mass % | 0.32 | 1.00 | 1.00 | ≤0.05 | 0.16 | 18.80 | 6.30 | 0.16 | — | — | — | Bal. | −0.19 | 0.71 |
| EX. 1 | | at % | 1.43 | 1.91 | 0.98 | 0.03 | 0.27 | 19.43 | 5.77 | 0.61 | — | — | — | | | |
| COMP. | 5.20 | mass % | 0.27 | 0.90 | 1.30 | ≤0.05 | 0.20 | 17.70 | 7.60 | 0.20 | — | 0.02 | — | | −0.32 | 0.94 |
| EX. 2 | | at % | 1.21 | 1.73 | 1.28 | 0.03 | 0.34 | 18.34 | 6.98 | 0.77 | — | 0.02 | — | | | |
| COMP. | 6.01 | mass % | 0.27 | 1.97 | 1.30 | ≤0.05 | 0.11 | 20.10 | 5.70 | 0.30 | 1.38 | — | — | | 25.32 | 1.08 |
| EX. 3 | | at % | 1.20 | 3.74 | 1.26 | 0.03 | 0.18 | 20.62 | 5.18 | 1.14 | 0.81 | — | — | | | |
| COMP. | 3.46 | mass % | 0.29 | 0.92 | 1.30 | ≤0.05 | 0.16 | 17.40 | 7.40 | 0.20 | — | — | — | | −0.20 | 1.01 |
| EX. 4 | | at % | 1.30 | 1.76 | 1.28 | 0.03 | 0.27 | 18.02 | 6.79 | 0.77 | 0.00 | — | — | | | |
| COMP. | 4.90 | mass % | 0.29 | 0.90 | 1.30 | ≤0.05 | 0.15 | 17.00 | 7.20 | 0.20 | <0.01 | — | — | | −0.17 | 1.02 |
| EX. 5 | | at % | 1.30 | 1.73 | 1.28 | 0.03 | 0.25 | 17.61 | 6.61 | 0.77 | 0.00 | — | — | | | |
| COMP. | 7.27 | mass % | 0.32 | 1.93 | 3.17 | ≤0.05 | 0.07 | 17.64 | 4.96 | 0.22 | 0.01 | — | — | | 0.10 | 2.96 |
| EX. 6 | | at % | 1.42 | 3.65 | 3.07 | 0.03 | 0.12 | 18.05 | 4.50 | 0.84 | 0.01 | — | — | | | |
| COMP. | 7.67 | mass % | 0.32 | 2.04 | 3.14 | ≤0.05 | 0.09 | 17.55 | 5.06 | 0.22 | <0.01 | — | — | | −0.08 | 2.89 |
| EX. 7 | | at % | 1.42 | 3.86 | 3.04 | 0.03 | 0.15 | 17.94 | 4.58 | 0.84 | 0.00 | — | — | | | |
| COMP. | 5.87 | mass % | 0.23 | 2.04 | 2.14 | ≤0.05 | 0.10 | 20.45 | 5.14 | 0.22 | 0.02 | — | — | | −0.35 | 1.91 |
| EX. 8 | | at % | 1.02 | 3.86 | 2.07 | 0.03 | 0.17 | 20.93 | 4.66 | 0.84 | 0.01 | — | — | | | |
| COMP. | 4.69 | mass % | 0.24 | 1.99 | 2.59 | ≤0.05 | 0.09 | 20.27 | 5.07 | 0.22 | 0.02 | — | — | | −0.29 | 2.36 |
| EX. 9 | | at % | 1.06 | 3.77 | 2.51 | 0.03 | 0.15 | 20.75 | 4.60 | 0.84 | 0.01 | — | — | | | |
| COMP. | 4.27 | mass % | 0.31 | 2.04 | 2.13 | ≤0.05 | 0.09 | 20.45 | 5.07 | 0.22 | 0.01 | — | — | | −0.18 | 1.91 |
| EX. 10 | | at % | 1.37 | 3.85 | 2.06 | 0.03 | 0.15 | 20.87 | 4.58 | 0.83 | 0.01 | — | — | | | |

<Result 1>

As is evident from Tables 1 and 2 as well, the value M satisfying the relationship of Expression (1) enables Mn, which contributes to the stabilization of austenite structure, to be dissolved in the austenite crystal grains and to be kept in the austenite crystal grains. Then the value P satisfying the relationship of Expression (2) enables finer austenite crystal grains due to Zr, and so Cr (chromium) segregated at the crystal grain boundary can be dispersed. This results in a decrease of the ferrite amount after heat treatment to be 3 mass % or less as illustrated in Tables 1 and 2 and FIG. 1.

Presumably that is why, as illustrated in FIG. 2, the austenite heat-resisting cast steel that is Example 18 of one example thereof has the structure in which the austenite crystal grains are made fine and the chromium carbide also can be dispersed as compared with Comparative Example 2.

As is evident from FIG. 1, the amount of ferrite generated in the austenite heat-resisting cast steel decreases due to the addition of Zr. Especially when the content of Zr is in the range of 0.25 to 0.5 mass %, the amount of ferrite phase generated during the application of thermal load can be decreased even when the content of Ni and Mn is limited. Herein, if the content of Zr is less than 0.25 mass %, the effect of making austenite crystal grains finer due to Zr may not be enough, resulting in segregation of chromium carbide at the crystal grain boundary and increase in the ferrite amount in some cases (see Comparative Examples 1, 8 and 9, for example). If the content of Zr exceeds 0.5 mass %, Zr and C will precipitate at the crystal grain boundary in some cases, resulting in a decrease in C (carbon), which is an element that stabilizes the austenite structure, in the austenite structure (see Comparative Example 2, for example).

Further, the relationship between the content of the elements (constituents) shown in Tables 1 and 2 and the ferrite amount measured (mass %) was analyzed by a multiple regression analysis. Specifically the analysis was made based on the amount of ferrite in the austenite heat-resisting cast steel generated when thermal load was applied to the austenite heat-resisting cast steel having the content of the elements in the above-stated range. Specifically elements that contribute to the generation or suppression of ferrite phase were specified, and the relationship between the content of these elements and the amount of ferrite phase generated (ferrite amount) was formulated using a regression expression as follows:

$$A=-2.35Ni-3.36Mn-1.46Cr+2.03Si-0.48Nb-0.51Zr-0.47Cu+49.86 \quad (3a)$$

Figure 3:
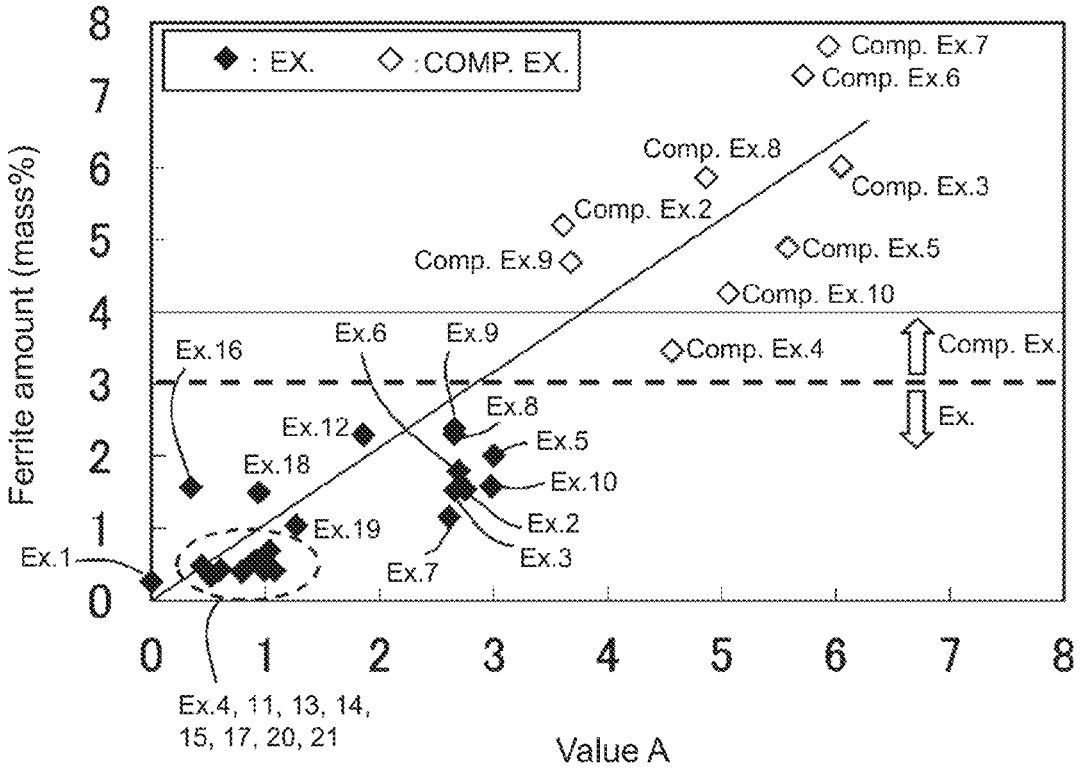
FIG. 3 illustrates the relationship between the value A and the ferrite amount of the austenite heat-resisting cast steel according to Examples 1 to 21 and Comparative Examples 2 to 10.

The symbols for elements in Expression (3a) represent values indicating the content of the elements corresponding to the symbols in the unit of mass %, and the value A indicates the predicted value of the ferrite amount. Positive coefficients of the elements indicate having the effect of generating ferrite phase, and negative coefficients indicate having the effect of suppressing ferrite phase. FIG. 3 illustrates the relationship between the value A and the ferrite amount of the austenite heat-resisting cast steel according to Examples 1 to 21 and Comparative Examples 1 to 10. As illustrated in FIG. 3, the correlation function of the value A using Expression (3a) and the ferrite amount $\alpha$ generated actually is $\alpha=1.0573A$, showing that the value A indicated in Expression (3a) substantially agrees with the actual ferrite amount generated in the austenite heat-resisting cast steel.

That is, when the content is specified so as to satisfy the following Expression (3), the ferrite amount (mass %) can be 3 mass % or less more reliably, and so stabilization of the austenite structure can be kept.

$$-2.35Ni-3.36Mn-1.46Cr+2.03Si-0.48Nb-0.51Zr-0.47Cu+49.86\leq 3 \quad (3).$$

<Oxidization Test>

The austenite heat-resisting cast steel of Examples 3 and 18 was cut into test pieces of 20 mm×30 mm×5 mm, which were placed into a furnace and kept at the constant temperature of 900° C. for 200 hours, and then were taken out from the furnace. Then oxidized scale on the surfaces of the test pieces was removed, and a change in weight before and after the test was measured.

Figure 4:
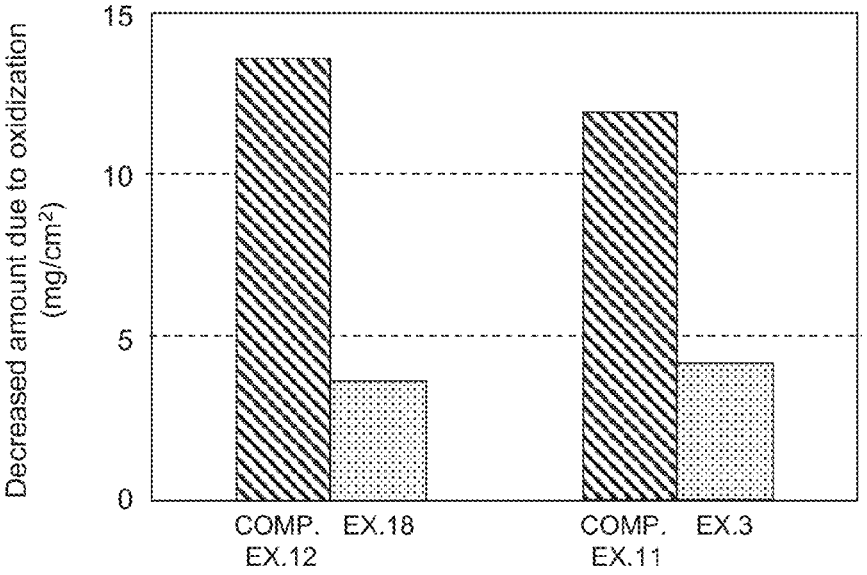
FIG. 4 illustrates the values of decreased amount due to oxidization of the austenite heat-resisting cast steel according to Examples 3 and 18 and Comparative Examples 11 and 12.

The decreased amount due to oxidization was calculated as $\Delta W=(Ws-Wo)/Ao$. Ws denotes weight (mg) of a test piece after heat treatment, Wo denotes weight (mg) of the test pieces after removing scale, and Ao denotes the surface area ($cm^2$) of the test piece. FIG. 4 shows the result. FIG. 4 illustrates the values of decreased amount due to oxidization of the austenite heat-resisting cast steel (the number of pieces evaluated n=2) according to Examples 3 and 18 and Comparative Examples 11 and 12 described later.

Further test pieces according to Comparative Example 11 and Comparative Example 12 were prepared, where Comparative Example 11 contained the same basic constituents as those of Example 3 and did not contain Zr, and Comparative Example 12 contained the same basic constituents of those of Example 18 and did not contain Zr. When oxidization test was performed to these test pieces in the same manner as in Examples 3 and 18, and the decreased amount due to oxidization thereof was measured. FIG. 4 shows the result.

As shown in FIG. 4, when the content of Zr was like Examples 3 and 18 (0.28 to 1.16 mass %), the decreased amount due to oxidization was decreased by 65 to 75 mass %, showing that the oxidization resistance can be remarkably improved.

That is a detailed description of the embodiments of the present invention. However, the present invention is not limited to the above-stated embodiments, and the design may be modified variously without departing from the spirits of the present invention defined in the attached claims.

What is claimed is:

1. Austenite heat-resisting cast steel, consisting of elements of 0.1 to 0.6 mass % of C, 1.0 to 2.5 mass % of Si, 1.0 to 3.5 mass % of Mn, 0.05 to 0.2 mass % of S, 14 to 24 mass % of Cr, 5 to 20 mass % of Ni, 0.1 to 0.3 mass % of N, 0.01 to 1.2 mass % of Zr, 0.01 to 1.5 mass % of Cu, 0.01 to 1.5 mass % of Nb, Fe as a remainder and unavoidable impurity, wherein the elements satisfy Expression (1) and Expression (2) in the following:

$$Mn—S\geq 1.0 \quad (1); \text{ and}$$

$$C-(1/12Cr-32Zr)>0 \quad (2),$$

where symbols for elements in Expressions (1) and (2) represent values indicating content of the elements corresponding to the symbols in a unit of atomic %.

2. The austenite heat-resisting cast steel according to claim 1, wherein the elements further satisfy Expression (3) in the following:

$$-2.35Ni-3.36Mn-1.46Cr+2.03Si-0.48Nb-0.51Zr-0.47Cu+49.86\leq 3 \quad (3),$$

where symbols for elements in Expression (3) represent values indicating content of the elements corresponding to the symbols in a unit of mass %.

3. The austenite heat-resisting cast steel according to claim 1, wherein Zr is in a range of 0.25 to 0.5 mass %.

4. The austenite heat-resisting cast steel according to claim 2, wherein Zr is in a range of 0.25 to 0.5 mass %.

* * * * *